US008300072B2

(12) United States Patent
Lee et al.

(10) Patent No.: US 8,300,072 B2
(45) Date of Patent: Oct. 30, 2012

(54) ELECTROPHORETIC DISPLAY HAVING IMPROVED GRAY-SCALE GENERATOR AND METHOD THEREOF

(75) Inventors: Il-Pyung Lee, Suwon-si (KR); Cheol-Woo Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 1115 days.

(21) Appl. No.: 11/930,252

(22) Filed: Oct. 31, 2007

(65) Prior Publication Data

US 2008/0278433 A1 Nov. 13, 2008

(30) Foreign Application Priority Data

Feb. 27, 2007 (KR) ..... 10-2007-0019805

(51) Int. Cl.
*G09G 5/02* (2006.01)

(52) U.S. Cl. ..... 345/694; 345/107

(58) Field of Classification Search ..... 345/107, 345/694, 690, 695; 359/296
See application file for complete search history.

(56) References Cited

U.S. PATENT DOCUMENTS

| | | | | |
|---|---|---|---|---|
| 6,577,291 | B2 * | 6/2003 | Hill et al. | 345/88 |
| 6,876,764 | B2 * | 4/2005 | Lee et al. | 382/162 |
| 7,177,067 | B1 * | 2/2007 | Sakamoto | 345/107 |
| 7,187,393 | B1 * | 3/2007 | Tokimoto et al. | 345/694 |
| 7,667,684 | B2 * | 2/2010 | Jacobson et al. | 345/107 |
| 2004/0263948 | A1 * | 12/2004 | Lee et al. | 359/296 |
| 2006/0214945 | A1 * | 9/2006 | Nitta et al. | 345/603 |
| 2006/0267892 | A1 * | 11/2006 | Pei et al. | 345/88 |
| 2008/0079755 | A1 * | 4/2008 | Shiomi | 345/690 |

FOREIGN PATENT DOCUMENTS

| | | | |
|---|---|---|---|
| JP | 2005-062833 | 3/2005 | |
| JP | 2006-113090 | 4/2006 | |
| JP | 2006-267541 | 10/2006 | |
| KR | 1020060048727 A | 5/2006 | |
| WO | WO 0057398 A1 * | 9/2000 | |
| WO | WO 2006070603 A1 * | 7/2006 | 345/690 |

* cited by examiner

*Primary Examiner* — Chanh Nguyen
*Assistant Examiner* — Allison Walthall
(74) *Attorney, Agent, or Firm* — Cantor Colburn LLP

(57) ABSTRACT

An electrophoretic display ("EPD") includes a display panel displaying an image and a gray-scale generator generating a gray-scale and providing a gray-scale voltage to the display panel. The gray-scale generator generates a gray-scale value of a white color using gray-scale values of red, green and blue colors and a brightness ratio between the red, green and blue colors. When a pure color is displayed, the EPD prevents the gray-scale of the white color from being fixed to 0. Thus, the EPD may enhance a chroma of the pure color and color brightness, thereby improving a display quality thereof.

8 Claims, 7 Drawing Sheets

ELECTROPHORETIC DISPLAY HAVING IMPROVED GRAY-SCALE GENERATOR AND METHOD THEREOF

This application claims priority to Korean Patent Application No. 2007-19805, filed on Feb. 27, 2007, and all the benefits accruing therefrom under 35 U.S.C. §119, the contents of which in its entirety are herein incorporated by reference.

BACKGROUND OF THE INVENTION

1. Field of the Invention

The present invention relates to an electrophoretic display and method thereof. More particularly, the present invention relates to an electrophoretic display capable of improving display characteristics thereof and the method thereof.

2. Description of the Related Art

In general, display apparatuses convert data in electric format, processed in an information processing unit, into image data and display the image data that are easily recognized visually. As one type of display apparatus, an electrophoretic display ("EPD") has a thin thickness and a light weight in comparison with other display devices such as a cold cathode ray tube ("CRT") display device, a liquid crystal display ("LCD"), etc.

Particularly, an EPD includes lower and upper substrates each on which electrodes are respectively arranged, and particles interposed between the lower and upper substrates. The particles are electrified to have a polarity, and move to the lower or upper substrate in accordance with an electric field applied between the lower and upper substrates. A phenomenon that the electrified particles move in accordance with the electric field is called an electrophoretic phenomenon, and the EPD displays the electrophoretic phenomenon of the particles. Since the EPD is a reflection type of display apparatus that displays an image using an external light, it does not need to have a separate light source. Further, the EPD has advantages of thin thickness and light weight since a layer constituted by the particles is thin.

However, when a full-color operation is performed, the chroma of pure color becomes lower and the image becomes indistinct, fuzzy and unclear because the EPD uses the external light. More specifically, in the EPD, red, green and blue pixels constitute one dot, and colors of the red, green and blue pixels in the dot are mixed with each other to display the image. Recently, an EPD to which a white pixel is added into the dot has been developed. In general, gray-scale values of the red, green and blue pixels are calculated from image data, and a gray-scale value of the white pixel is calculated from a smallest gray-scale value among the red, green and blue gray-scale values.

However, in a case of pure colors such as red, green and blue, since one of the red, green and blue pixels has a gray-scale value of zero, the gray-scale value of the white pixel is fixed to zero when the pure colors are displayed. Consequently, the pure colors displayed on the EPD become indistinct, and a display quality of the EPD is deteriorated.

BRIEF SUMMARY OF THE INVENTION

The present invention provides an electrophoretic display ("EPD") capable of enhancing a gray-scale display range and a brightness thereof.

The present invention also provides a method of improving display characteristics of an EPD.

In exemplary embodiments of the present invention, an EPD includes a display panel and a gray-scale generator.

The display panel includes first, second, third and fourth pixel areas. The display panel includes a plurality of electrophoretic particles arranged in the first to fourth pixel areas. The display panel receives gray-scale voltages corresponding to the first to fourth pixel areas, respectively, and displays an image. The gray-scale generator receives an image signal to generate gray-scale values corresponding to the first to third pixel areas, respectively. The gray-scale generator generates a gray-scale value corresponding to the fourth pixel area using a brightness ratio between the first, second and third pixel areas and the gray-scale values of the first to third pixel areas. The gray-scale generator outputs the gray-scale voltages according to the gray-scale values of the first to fourth pixel areas.

The gray-scale value of the fourth pixel area may be obtained by adding a first value obtained by multiplying a brightness ratio constant of the first pixel area by the gray-scale value of the first pixel area, a second value obtained by multiplying a brightness ratio constant of the second pixel area by the gray-scale value of the second pixel area, and a third value obtained by multiplying a brightness ratio constant of the third pixel area by the gray-scale value of the third pixel area. The brightness ratio constant of each of the first, second and third pixel areas may be obtained from the brightness ratio between the first, second and third pixel areas when the first, second and third pixel areas have a same gray-scale value.

Also, the gray-scale value of the first pixel area may be a red-color gray-scale value, the gray-scale value of the second pixel area may be a green-color gray-scale value, the gray-scale value of the third pixel area may be a blue-color gray-scale value, and the gray-scale value of the fourth pixel area may be a white-color gray-scale value.

In other exemplary embodiments of the present invention, an EPD includes a display panel and a gray-scale generator.

The display panel includes first, second and third pixel areas arranged in a first direction. Each of the first, second and third pixel areas has a main area and a sub area that is adjacent to the main area, and each sub area displays a white color. The display panel includes a plurality of electrophoretic particles that has a color and a polarity and is arranged in the first, second and third pixel areas. The display panel receives gray-scale voltages of the main and sub areas and displays an image. The gray-scale generator receives an image signal to generate a gray-scale value corresponding to the main area of each of the first, second and third pixel areas. The gray-scale generator generates a gray-scale value corresponding to the sub area of each of the first, second and third pixel areas by using the gray-scale value corresponding to the main area of each of the first, second and third pixel areas. The gray-scale generator outputs the gray-scale voltages according to the generated gray-scale values.

The gray-scale generator may generate a first gray-scale value corresponding to the white color based on a brightness ratio between the main areas of the first to third pixel areas and the gray-scale values of the main areas, and at least one of the sub areas has the first gray-scale value.

The gray-scale generator may multiply a smallest gray-scale value among the gray-scale values of the main areas of the first to third pixel areas by a white ratio constant to calculate a second gray-scale value corresponding to the white color. A remaining sub area except for the at least one sub area may have the second gray-scale value. The white brightness constant may be used to adjust a white color ratio with respect to a color generated by mixing colors displayed in the first to third pixel areas and may have a value of about 0 to about 1.

In still other exemplary embodiments of the present invention, a method of improving display characteristics of an EPD, the EPD including a dot area composed of a plurality of pixel areas displaying red, green, blue, and white colors, the method including generating gray-scale values in the gray-scale generator respectively corresponding to the red, green, and blue colors, generating a gray-scale value in the gray-scale generator corresponding to the white color using a brightness ratio between the red, green, and blue colors and the gray-scale values of the red, green, and blue colors, and outputting gray-scale voltages according to the gray-scale values of the red, green, blue, and white colors.

According to the above, the EPD may prevent a chroma of a pure color from being lowered since the gray-scale of the white color is not fixed to zero when displaying the pure color.

BRIEF DESCRIPTION OF THE DRAWINGS

The above and other features and advantages of the present invention will become readily apparent by reference to the following detailed description when considered in conjunction with the accompanying drawings wherein.

DETAILED DESCRIPTION OF THE INVENTION

Figure 1:
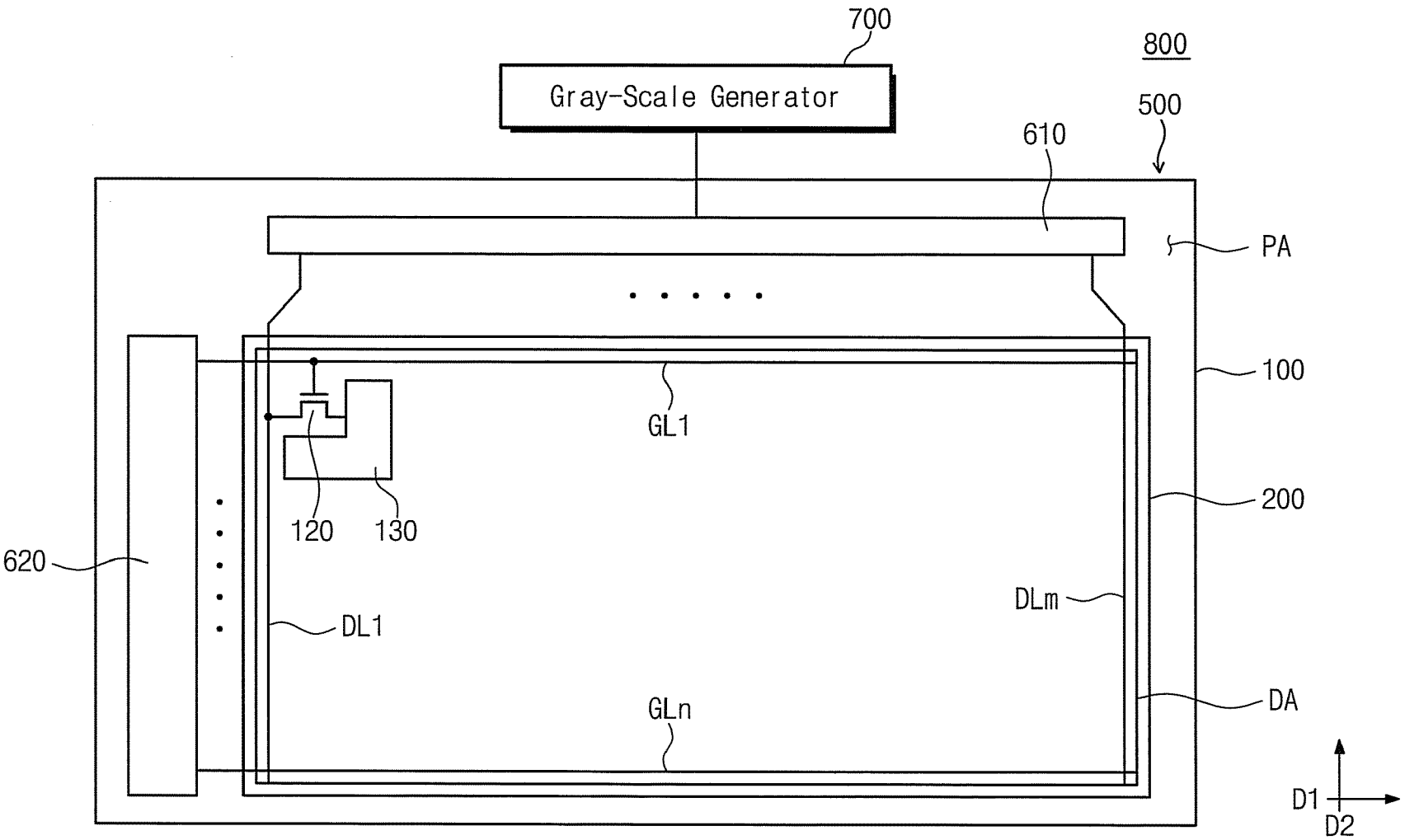
FIG. 1 is a plan view showing an exemplary embodiment of an electrophoretic display ("EPD") according to the present invention.

Hereinafter, the present invention will be explained in detail with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the thickness of layers, films, and regions are exaggerated for clarity. Like numerals refer to like elements throughout.

It will be understood that when an element such as a layer, film, region, or substrate is referred to as being "on" another element, it can be directly on the other element or intervening elements may also be present. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Figure 2:
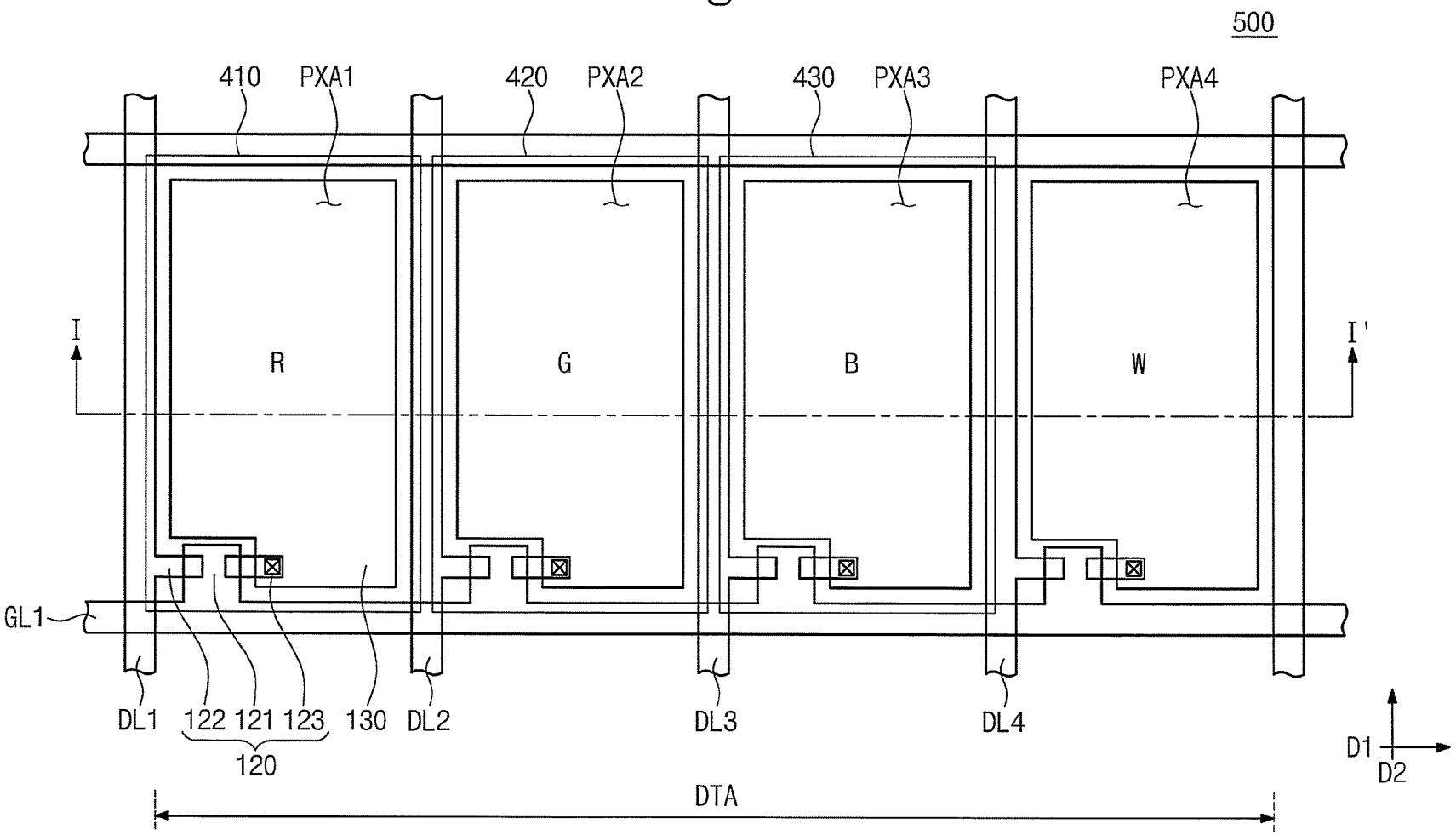
FIG. 2 is a plan view showing a portion of an exemplary display panel of FIG. 1.
Figure 3:
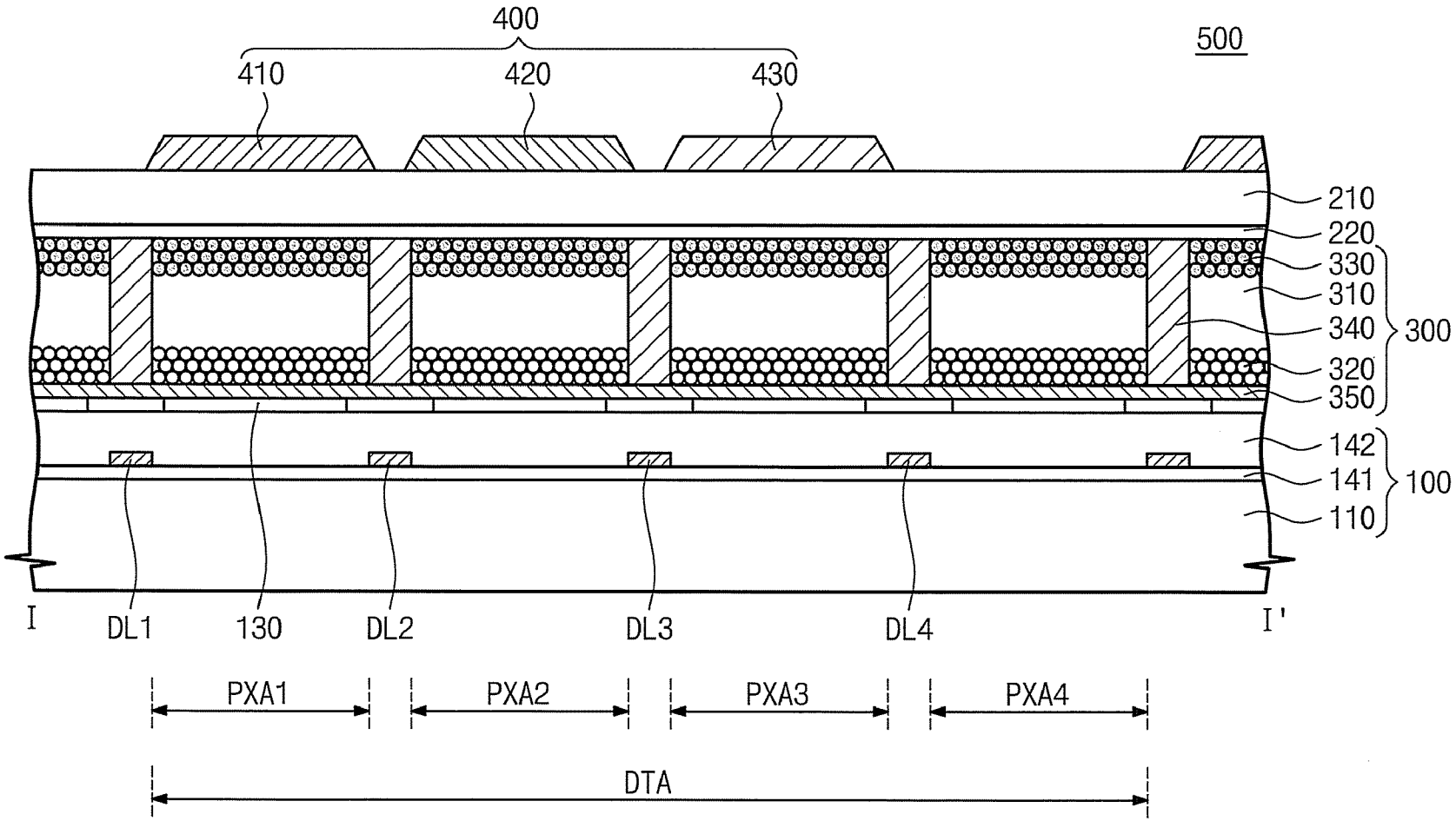
FIG. 3 is a cross-sectional view taken along line I-I' of FIG. 2.

FIG. 1 is a plan view showing an exemplary embodiment of an electrophoretic display ("EPD") according to the present invention, FIG. 2 is a plan view showing a portion of an exemplary display panel of FIG. 1, and FIG. 3 is a cross-sectional view taken along line I-I' of FIG. 2.

Referring to FIGS. 1 to 3, an EPD 800 includes a display panel 500 displaying an image, a data driver 610 mounted on the display panel 500, a gate driver 620 mounted on the display panel 500, and a gray-scale generator 700 receiving an image signal and outputting a gray-scale voltage to the data driver 610.

The display panel 500 includes a first display substrate 100, a second display substrate 200 facing the first display substrate 100, an electrophoretic layer 300 interposed between the first and second display substrates 100 and 200, and a color filter 400.

The first display substrate 100 includes a first base substrate 110, a plurality of gate lines GL1~GLn, a plurality of data lines DL1~DLm, a plurality of thin film transistors ("TFTs"), such as TFT 120, and a plurality of pixel electrodes, such as pixel electrode 130.

The first base substrate 110 is divided into a display area DA on which an image is displayed and a peripheral area PA surrounding the display area DA. The display area DA includes a plurality of dot areas DTA each of which has first, second, third and fourth pixel areas PXA1, PXA2, PXA3 and PXA4 that are sequentially arranged along a first direction D1.

The gate lines GL1~GLn and the data lines DL1~DLm are arranged on the first base substrate 110. The gate lines GL1~GLn extend in the first direction D1. The gate lines GL1~GLn receive gate signals from the gate driver 620 and provide the gate signals to the TFTs. The data lines DL1~DLm extend in a second direction D2 substantially perpendicular to the first direction D1. The data lines DL1~DLm are insulated from and intersected with the gate lines GL1~GLn. In one exemplary embodiment, the data lines DL1~DLm and the gate lines GL1~GLn may define the first to fourth pixel areas PXA1~PXA4. The data lines DL1~DLm receive data signals from the data driver 610 and provide the data signals to the TFTs.

The TFTs and the pixel electrodes are arranged in the first to fourth pixel areas PXA1~PXA4 in a one-to-one fashion. That is, each of the TFTs 120 is connected to a corresponding data line among the data lines DL1~DLm and to a corresponding gate line among the gate lines GL1~GLn. For instance, the TFT 120 arranged in the first pixel area PXA1 includes a gate electrode 121 extended from the first gate line GL1, a source electrode 122 extended from the first data line DL1 and positioned at an upper side of the gate electrode 121, and a drain electrode 123 connected to a pixel electrode 130 arranged in the first pixel area PXA1. Each of the pixel electrodes 130 receives a pixel voltage that is determined according to a gray-scale voltage applied to a corresponding pixel area.

The first display substrate 100 further includes a first insulation layer 141 arranged on the first base substrate 110 to cover the gate lines GL1~GLn, and a second insulation layer 142 arranged on the first insulation layer 141 to cover the data lines DL1~DLm. In the present exemplary embodiment, the pixel electrodes 130 are arranged on the second insulation layer 142.

The second display substrate 200 is disposed on the first display substrate 100. The second display substrate 200 includes a second base substrate 210 facing the first base substrate 110 and a common electrode 220 arranged on the second base substrate 210. As an example of the present exemplary embodiment, the second base substrate 210 includes a flexible material such as polyethyleneterephthalate ("PET"). The common electrode 220 faces the pixel electrodes 130 and receives a common voltage. In the present exemplary embodiment, the common electrode 220 includes a transparent conductive material such as indium tin oxide ("ITO"), indium zinc oxide ("IZO"), etc.

The electrophoretic layer 300 interposed between the first and second display substrates 100 and 200 includes a fluid layer 310 of insulating liquid, a plurality of white particles 320 dispersed in the fluid layer 310, a plurality of black particles 330 dispersed in the fluid layer 310, and a barrier wall 340.

More specifically, the white particles 320 of white color are electrified to have a polarity, and arranged in each of the first to fourth pixel areas PXA1~PXA4. The black particles 330 of black color are electrified to have a polarity opposite to the polarity of the white particles 320, and arranged in each of the first to fourth pixel areas PXA1~PXA4.

The white particles 320 and the black particles 330 move to either the first display substrate 100 or the second display substrate 200 according to an electric field formed between the common electrode 220 and the pixel electrodes 130. In each of the first to fourth pixel areas PXA1~PXA4, the gray-scale depends on colors of the particles positioned adjacent to the second display substrate 200, and the colors and the number of the particles positioned adjacent to the second display substrate 200 are determined in accordance with the gray-scale value of a corresponding pixel area in which the particles are arranged.

The first and second display substrates 100 and 200 are spaced apart from each other by the barrier wall 340, and the fluid layer 310, the white particles 320 and the black particles 330 may be received between the first and second display substrates 100 and 200. The barrier wall 340 surrounds each of the first to fourth pixel areas PXA1~PXA4 to prevent the fluid layer 310, the white particles 320 and the black particles 330 from being moved between adjacent pixel areas among the first to fourth pixel areas PXA1~PXA4.

In the present exemplary embodiment, the fluid layer 310 is separated into the first to fourth pixel areas PXA1~PXA4, and both the white particles 320 and the black particles 330 are also separated into the first to fourth pixel areas PXA1~PXA4. However, the electrophoretic layer 300 may include microcapsules of ball-like shape, in each of which the fluid layer 310, the white particles 320 and the black particles 330 are encapsulated. In this case, the electrophoretic layer 300 does not need to have the barrier wall 340.

The electrophoretic layer 300 further includes an adhesive 350 that attaches the electrophoretic layer 300 to the first display substrate 100. The adhesive 350 is disposed between the fluid layer 310 and the first display substrate 100 and between the barrier wall 340 and the first display substrate 100 to attach the electrophoretic layer 300 to the first display substrate 100. The electrophoretic layer 300 may also be integrally formed with the second display substrate 200 as a film shape.

The color filter 400 is arranged on the second display substrate 200. The color filter 400 includes various color filters formed on the second display substrate 200, and includes at least one color pixel among red, green and blue color pixels 410, 420 and 430. In one exemplary embodiment, red, green, and blue color filters of the color filter 400 may define the red, green, and blue color pixels 410, 420, and 430. The red, green and blue color pixels 410, 420 and 430 display colors using light reflected from the white and black particles 320 and 330, thereby displaying the image.

Particularly, the red, green and blue color pixels 410, 420 and 430 are arranged on the second base substrate 210 in correspondence with the first, second and third pixel areas PXA1, PXA2 and PXA3, respectively, and no color pixel is arranged in the fourth pixel area PXA4. In other words, a portion of the color filter 400 is not provided in the fourth pixel area PXA4.

In the present exemplary embodiment, the red color pixel 410 is arranged in the first pixel area PXA1, the green color pixel 420 is arranged in the second pixel area PXA2, and the blue color pixel 430 is arranged in the third pixel area PXA3. Thus, red, green, blue and white colors are displayed in the first to fourth pixel areas PXA1~PXA4. However, the user may not distinctly recognize the colors displayed on each of the first, second, third and fourth pixel areas PXA1, PXA2, PXA3 and PXA4 through the naked eyes, but may recognize the color with which the colors displayed on each of the first, second, third and fourth pixel areas PXA1, PXA2, PXA3 and PXA4 are mixed in the dot area DTA.

The data driver 610 and the gate driver 620 are arranged in the peripheral area PA of the display panel 500. The data driver 610 receives the gray-scale voltage from the gray-scale generator 700 to output the data signal to the data lines DL1 to DLm, and the gate driver 620 outputs the gate signal to the gate lines GL1 to GLn.

The gray-scale generator 700 receives the image signal from an exterior to output gray-scale voltages corresponding to the first to fourth pixel areas PXA1~PXA4, respectively. In other words, the gray-scale generator 700 receives the image signal to generate the gray-scale value of the red, green and blue colors in each dot area DTA and generate the gray-scale value of the white color corresponding to each dot area DTA using the gray-scale values of the red, green and blue colors. The gray-scale generator 700 generates the gray-scale voltages based on the gray-scale values and provides the data driver 610 with the gray-scale voltages. In the present exemplary embodiment, the gray-scale value of the red color represents the gray-scale value of the first pixel area PXA1, the gray-scale value of the green color represents the gray-scale value of the second pixel area PXA2, the gray-scale value of the blue color represents the gray-scale value of the third pixel area PXA3, and the gray-scale value of the white color represents the gray-scale value of the fourth pixel area PXA4.

More specifically, the gray-scale generator 700 generates the gray-scale value of the fourth pixel area PXA4 (e.g. the gray-scale value of the white color) using brightness ratio between the red, green and blue colors and the gray-scale values of the first to third pixel areas PXA1~PXA3. The gray-scale value of the white color is obtained through Equation 1 as follow.

$$WG=(C1\times RG)+(C2\times GG)+(C3\times BG) \quad \text{Equation 1}$$

In Equation 1, WG represents the gray-scale value of the white color, C1, C2 and C3 represent first, second and third brightness ratio constants, respectively, RG represents the gray-scale value of the red color, GG represents the gray-scale value of the green color, and BG represents the gray-scale value of the blue color.

Referring to FIG. 2 and Equation 1, the gray-scale value of the white color WG is obtained by adding together a first value obtained by multiplying the gray-scale value of the red color RG by the first brightness ratio constant C1, a second value obtained by multiplying the gray-scale value of the green color GG by the second brightness ratio constant C2, and a third value obtained by multiplying the gray-scale value of the blue color by the third brightness ratio constant C3.

The first, second and third brightness ratio constants C1, C2 and C3 are obtained using the brightness ratio between the red, green and blue colors when the red, green and blue colors have the same gray-scale. The brightness ratio between the red, green and blue colors is 3:6:1 when they have the same gray-scale. When the ranges of the first, second and third brightness ratio constants C1, C2 and C3 are determined using the brightness ratio, the first brightness constant C1 is in a range of about 0.2 to about 0.4, the second brightness constant C2 is in a range of about 0.5 to about 0.7, and the third brightness ratio constant C3 is in a range of about 0.05 to about 0.2. In the present exemplary embodiment, a sum of the first, second and third brightness ratio constants C1, C2 and C3 is 1 (one). The first, second and third brightness ratio constants C1, C2 and C3 are adjusted according to the color that will have high brightness among the red, green and blue colors in each dot area DTA. For instance, in a case of enhancing the brightness of the green color, the second brightness ratio constant C2 is set to about 0.7, and then the first brightness ratio constant C1 and the third brightness ratio constant C3 are correspondingly set.

As described above, since the EPD 800 calculates the gray-scale value of the white color WG using the brightness ratio between the red, green and blue colors and the gray-scale values of the red, green and blue colors, the EPD 800 may prevent the gray-scale value of the white color from being fixed to zero when displaying the pure color. Consequently, the EPD 800 may enhance the chroma of the pure color and increase the gray-scale display range, thereby improving a display quality thereof.

Figure 4:
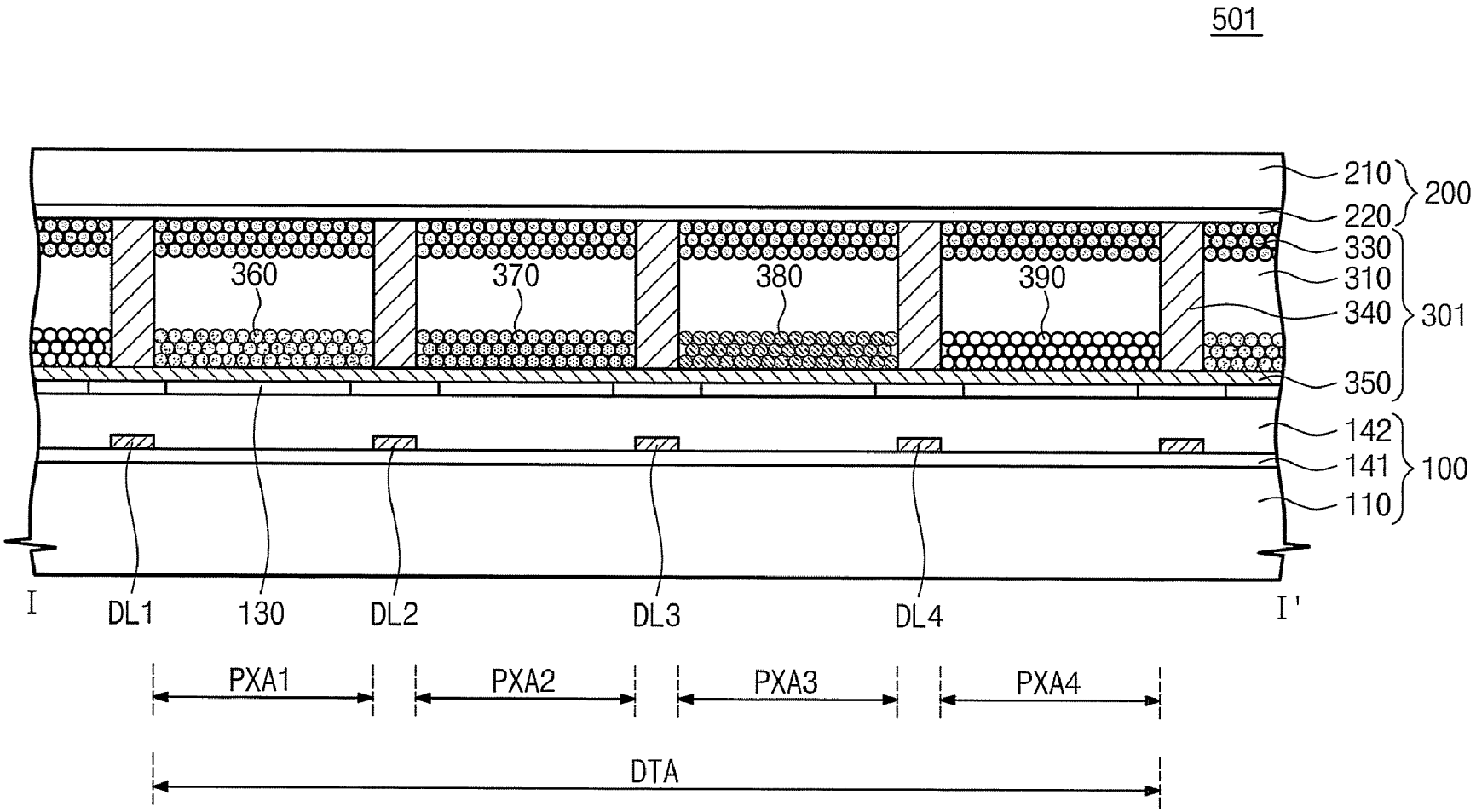
FIG. 4 is a cross-sectional view showing a portion of another exemplary embodiment of the display panel of FIG. 2.

FIG. 4 is a cross-sectional view showing a portion of another exemplary embodiment of the display panel of FIG. 2. In FIG. 4, the same reference numerals denote the same elements in FIGS. 1 to 3, and thus the detailed descriptions of the same elements will be omitted.

Referring to FIG. 4, the display panel 501 includes a first display substrate 100, a second display substrate 200 facing the first display substrate 100, and an electrophoretic layer 301 interposed between the first and second display substrates 100 and 200.

The first display substrate 100 includes at least one dot area DTA defined thereon, and the dot area DTA is divided into first, second, third and fourth pixel areas PXA1, PXA2, PXA3 and PXA4. The second display substrate 200 is disposed on the first display substrate 100 and includes a common electrode 220 arranged on a face of the second display substrate 200 such that the common electrode 220 faces the first display substrate 100.

The electrophoretic layer 301 includes a fluid layer 310 of insulating liquid, black, red, blue, green and white particles 330, 360, 370, 380 and 390, and a barrier wall 340.

In the present exemplary embodiment, the red particles 360 are arranged in the first pixel area PXA1 and have a red color, the green particles 370 are arranged in the second pixel area PXA2 and have a green color, the blue particles 380 are arranged in the third pixel area PXA3 and have a blue color, and the white particles 390 are arranged in the fourth pixel area PXA4 and have a white color. The black particles 330 are arranged in the first to fourth pixel areas PXA1~PXA4 and have a black color. The black particles 330 have a different polarity from those of the red, green, blue and white particles 360, 370, 380 and 390. The red, green, blue and white particles 360, 370, 380 and 390 have the same polarity as each other. The display panel 501 displays the image by employing the principle that the black, red, green, blue and white particles 330, 360, 370, 380 and 390 reflect the external light to display colors thereof.

More specifically, the black, red, green, blue, and white particles 330, 360, 370, 380 and 390 move to either the first display substrate 100 or the second display substrate 200 in accordance with an electric field between the common electrode 220 and the pixel electrodes. The gray-scale of the first to fourth pixel areas PXA1~PXA4 depends on the colors and the number of the particles positioned adjacent to the second display substrate 200, and the colors and the numbers of the particles positioned adjacent to the second display substrate 200 are determined according to gray-scale value of the pixel areas PXA1~PXA4.

In the present exemplary embodiment, a method of determining the gray-scale values of the first to fourth pixels PXA1~PXA4 is same as, or may substantially the same as, that of the gray-scale values of the display panel 500 shown in FIGS. 1 to 3.

The first and second display substrates 100 and 200 are spaced apart from each other by the barrier wall 340, and the fluid layer 310, and the black, red, green, blue and white particles 330, 360, 370, 380 and 390 are received between the first and second display substrates 100 and 200. The barrier wall 340 surrounds each of the first to fourth pixel areas PXA1~PXA4 to prevent the fluid layer 310, the black particles 330, the red particles 360, the green particles 370, the blue particles 380 and the white particles 390 from moving between adjacent pixel areas among the first to fourth pixel areas PXA1~PXA4. In this exemplary embodiment, a color filter need not be formed on the second display substrate 200 as in the prior exemplary embodiment.

In the present exemplary embodiment, the fluid layer 310, the black particles 330, the red particles 360, the green particles 370, the blue particles 380 and the white particles 390 are separated into the first to fourth pixel areas PXA1~PXA4. However, the electrophoretic layer 301 may include microcapsules of ball-like shape, in each which the fluid layer 310, the black particles 330 and one of the red, green, and white particles 360, 370, 380 and 390 are encapsulated. In this case, the electrophoretic layer 301 does not need to have the barrier wall 340.

The electrophoretic layer 301 further includes an adhesive 350 that attaches the electrophoretic layer 301 to the first display substrate 100. The adhesive 350 is disposed between the fluid layer 310 and the first display substrate 100 and between the barrier wall 340 and the first display substrate 100 to attach the electrophoretic layer 301 to the first display substrate 100. Further, the electrophoretic layer 301 may be integrally formed with the second display substrate 200 as a film shape.

Figure 5:
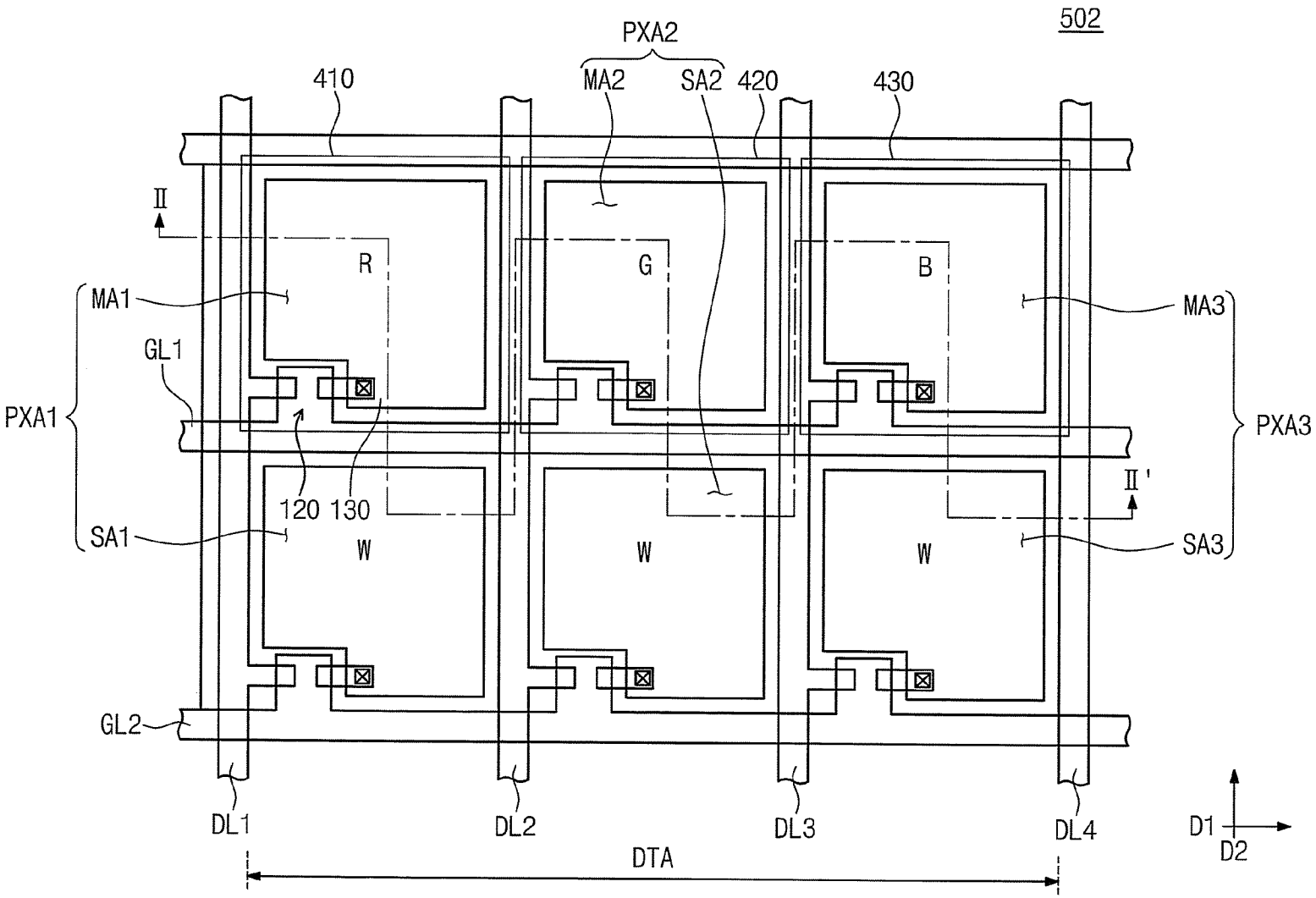
FIG. 5 is a plan view showing a portion of another exemplary embodiment of an EPD according to the present invention.
Figure 6:
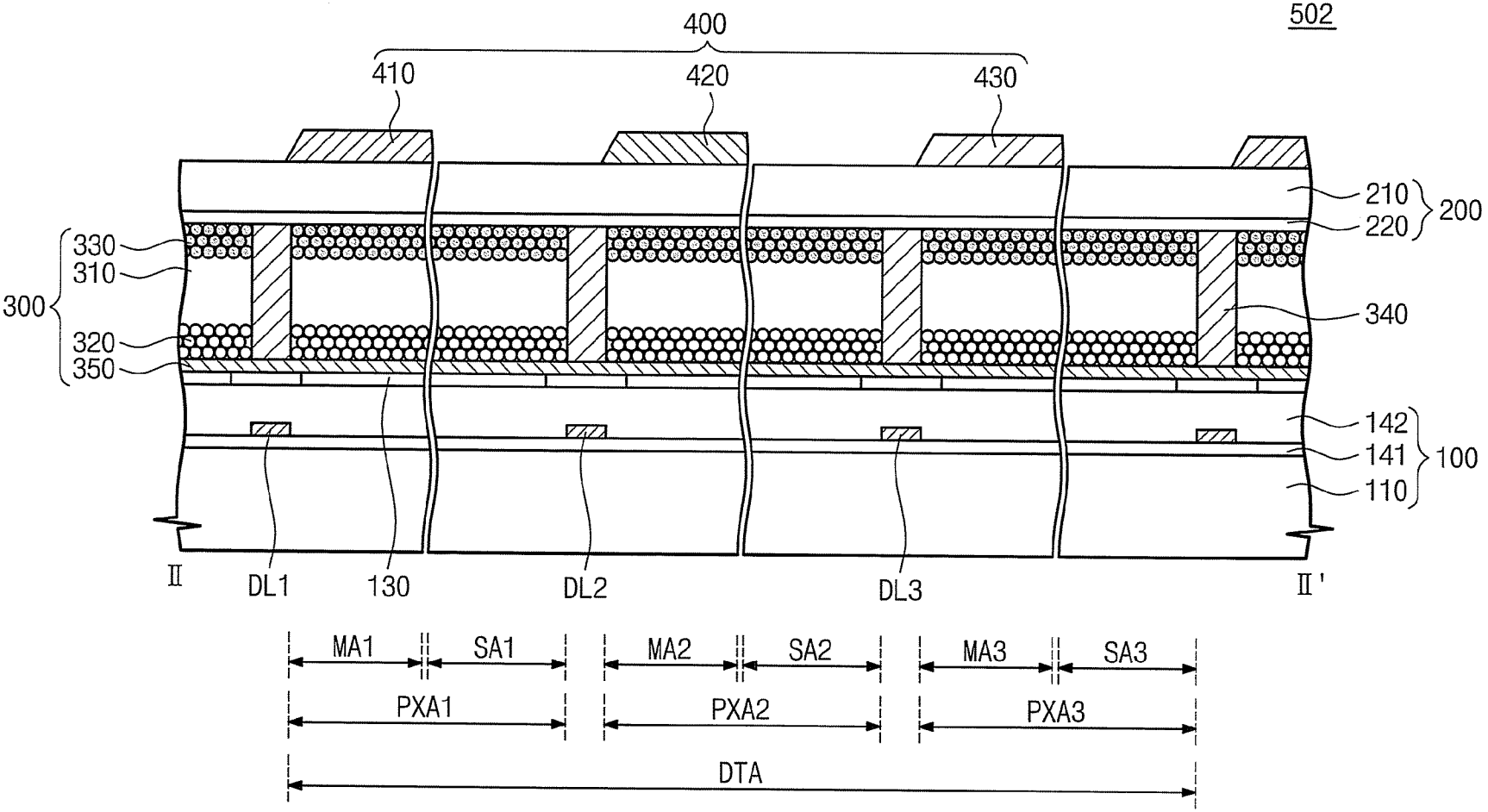
FIG. 6 is a cross-sectional view taken along line II-II' of FIG. 5.

FIG. 5 is a plan view showing a portion of another exemplary embodiment of an EPD according to the present invention, and FIG. 6 is a cross-sectional view taken along line II-II' of FIG. 5. In FIGS. 5 and 6, the same reference numerals denote the same elements in FIGS. 1 to 3, and thus the detailed descriptions of the same elements will be omitted.

Referring to FIGS. 1, 5 and 6, a display panel 502 includes a first display substrate 100, a second display substrate 200, an electrophoretic layer 300 and a color filter 400.

The first display substrate 100 includes a first base substrate 110, a plurality of gate lines GL1~GLn, a plurality of data lines DL1~DLm, a TFT 120, and a pixel electrode 130.

The first base substrate 110 includes a display area DA on which an image is displayed and a peripheral area PA surrounding the display area DA, and the display area DA includes a plurality of dot areas DTA. Each dot area DTA includes first, second and third pixel areas PXA1, PXA2 and PXA3 sequentially arranged in a first direction D1. The first pixel area PXA1 includes a first main area MA1 and a first sub area SA1, the second area PXA2 includes a second main area MA2 and a second sub area SA2, and the third pixel area PXA3 includes a third main area MA3 and a third sub area SA3. The first to third sub areas SA1~SA3 are arranged adjacent to each other in the first direction D1 and are respectively arranged adjacent to the first to third main areas MA1~MA3.

In one exemplary embodiment, the first to third main areas MA1~MA3 and the first to third sub areas SA1~SA3 may be defined by the gate lines GL1~GLn and the data lines DL1~DLm. The TFT 120 and the pixel electrode 130 are arranged in each of the first to third main areas MA1~MA3 and in each of the first to third sub areas SA1~SA3.

The second display substrate 200 is disposed on the first display substrate 100. The second display substrate 200 includes a common electrode 220 arranged on a face thereof, which faces the first display substrate 100.

The electrophoretic layer 300 is disposed between the first and second display substrates 100 and 200. The electrophoretic layer 300 includes a fluid layer 310 of insulating liquid, a plurality of white particles 320 dispersed in the fluid layer 310, a plurality of black particles 330 dispersed in the fluid layer 310, and a barrier wall 340.

Particularly, the white particles 320 have a white color. The white particles 320 are electrified to have a polarity and are arranged in each of the first to third main areas MA1~MA3 and in each of the first to third sub areas SA1~SA3. The black particles 330 have a black color and a different polarity from the white particles 320. The black particles 330 are arranged in each of the first to third main areas MA1~MA3 and in each of the first to third sub areas SA1~SA3.

The white particles 320 and the black particles 330 move to either the first display substrate 100 or the second display substrate 200 in accordance with an electric field formed between the common electrode 220 and the pixel electrodes 130. The gray-scales of the first to third main areas MA1~MA3 and the gray-scales of the first to third sub areas SA1~SA3 depend on the colors and number of the particles positioned adjacent to the second display substrate 200. The colors and the number of the particles positioned adjacent to the second display substrate are determined according to the gray-scale values of the corresponding pixel areas.

The first and second display substrates 100 and 200 are spaced apart from each other by the barrier wall 340, and the fluid layer 310 and the white and black particles 320 and 330 are received between the first and second display substrates 100 and 200. The barrier wall 340 surrounds each of the first to third main areas MA1~MA3 and each of the first to third sub areas SA1~SA3 to prevent the fluid layer 310, the white particles 320 and the black particles 330 from being moved between adjacent main areas MA1~MA3 and between adjacent sub areas SA1~SA3.

In the present exemplary embodiment, the fluid layer 310, the white particles 320 and the black particles 330 are separated into the first to third main areas MA1~MA3 and into the first to third sub areas SA1~SA3 of each dot area DTA by the barrier wall 340. However, the electrophoretic layer 300 may include microcapsules of ball-like shape, in each which the fluid layer 310, the white particles 320 and the black particles 330 are encapsulated. In this case, the electrophoretic layer 300 does not need to have the barrier wall 340.

The electrophoretic layer 300 further includes an adhesive 350 that attaches the electrophoretic layer 300 to the first display substrate 100. The adhesive 350 is disposed between the fluid layer 310 and the first display substrate 100 and between the barrier wall 340 and the first display substrate 100 to attach the electrophoretic layer 300 to the first display substrate 100.

Further, the electrophoretic layer 300 may be integrally formed with the second display substrate 200 as a film shape.

The color filter 400 is arranged on the second display substrate 200. The color filter 400 includes various color filters formed on the second display substrate 200, and includes at least one red, green and blue color pixels 410, 420 and 430 displaying the colors using the light reflected from the white and black particles 320 and 330. In one exemplary embodiment, red, green, and blue color filters of the color filter 400 may define the red, green, and blue color pixels 410, 420, and 430. The red, green and blue color pixels 410, 420 and 430 are arranged on the second base substrate 210 and correspond to the first to third main areas MA1~MA3 in a one-to-one fashion. In other words, portions of the color filter 400 are not formed on the first to third sub areas SA1~SA3.

As an example of the present exemplary embodiment, the red color pixel 410 is arranged in the first main area MA1, the green color pixel 420 is arranged in the second main area MA2, and the blue color pixel 430 is arranged in the third main area MA3. Thus, the red, green and blue colors are displayed on the first to third main areas MA1~MA3, respectively, in accordance with the gray-scale values of the first to third main areas MA1~MA3. Since the color filter 400 is not arranged in the first to third sub areas SA1~SA3, the color is displayed on the first to third sub areas SA1~SA3 in accordance with the gray-scale values of the first to third sub areas SA1~SA3.

The gray-scale values of the first to third main areas MA1~MA3 and the gray-scale values of the first to third sub areas SA1~SA3 are set by the gray-scale generator 700. The gray-scale generator 700 receives the image signal to generate the gray-scale values of the red, green and blue colors in each dot area DTA. The gray-scale generator 700 generates the gray-scale value of the white color corresponding to the dot area DTA using the gray-scales of the red, green and blue colors. In the present exemplary embodiment, the gray-scale value of the red color represents the gray-scale value of the first main area MA1, the gray-scale value of the green color represents the gray-scale value of the second main area MA2, the gray-scale value of the blue color represents the gray-scale value of the third main area MA3, and the gray-scale value of the white color represents the gray-scale values of the first to third sub areas SA1~SA3.

More specifically, the gray-scale generator 700 generates at least one gray-scale value of the gray-scale values of the first to third sub areas SA1~SA3 by using the brightness ratio between the red, green and blue colors and the gray-scale values of the red, green and blue colors (e.g. the gray scales of the first to third main areas MA1~MA3). The gray-scale values of the first to third sub areas SA1~SA3 are obtained by Equation 2 as follow. Hereinafter, the gray-scale value of the white color obtained by using the brightness ratio between the red, green and blue colors and the gray-scales of the first to third main areas MA1~MA3 are referred to as a first white gray-scale.

$$WG1=(C1\times RG)+(C2\times GG)+(C3\times BG) \quad \text{Equation 2}$$

In Equation 2, WG1 represents the first white gray-scale, C1, C2 and C3 represent first, second and third brightness ratio constants, respectively, RG represents the gray-scale value of the red color, GG represents the gray-scale value of the green color, and BG represents the gray-scale value of the blue color. The first to third brightness ratio constants are the same as those in Equation 1.

Referring to FIG. 5 and Equation 2, the first white gray-scale value WG1 is obtained by adding a first value obtained by multiplying the gray-scale value of the first main area MA1 by the first brightness ratio constant C1, a second value obtained by multiplying the gray-scale value of the second main area MA2 by the second brightness ratio constant C2, and a third value obtained by multiplying the gray-scale value of the third main area MA3 by the third brightness ratio constant C3. Thus, the display panel 502 may prevent the first gray-scale value of the white color WG1 from being fixed to zero when displaying the pure color. Consequently, the display panel 502 may enhance the chroma of the pure color and increase the gray-scale display range, thereby improving a display quality thereof.

Meanwhile, the gray-scale generator 700 provides a second white gray-scale value to the remaining sub areas among the first to third sub areas SA1~SA3, to which the first white gray-scale value WG1 is not applied, and the second white gray-scale value is obtained by Equation 3 as follow.

$$WG2=V\min\times WC \quad \text{Equation 3}$$

In Equation 3, WG2 represents the second white gray-scale, Vmin represents a smallest gray-scale value among the gray-scale values of the first to third main areas MA1~MA3, and WC represents a white ratio constant used to adjust a ratio of white color of the color displayed on the dot area DTA, which is obtained by mixing the colors of the first to third pixel areas PXA1~PXA3.

Referring to FIG. 5 and Equation 3, the second white gray-scale value WG2 is obtained by multiplying the smallest gray-scale value Vmin among the gray-scale values of the first to third main areas MA1~MA3 by the white ratio constant WC. The white ratio constant WC has a value of about 0 to about 1, and white color components of the color displayed on the dot area DTA increase as the white ratio constant WC increases. Thus, the EPD 800 may adjust the color brightness of the dot area DTA using the second white gray-scale WG2, so that the display quality of the EPD 800 may be improved.

Figure 7:
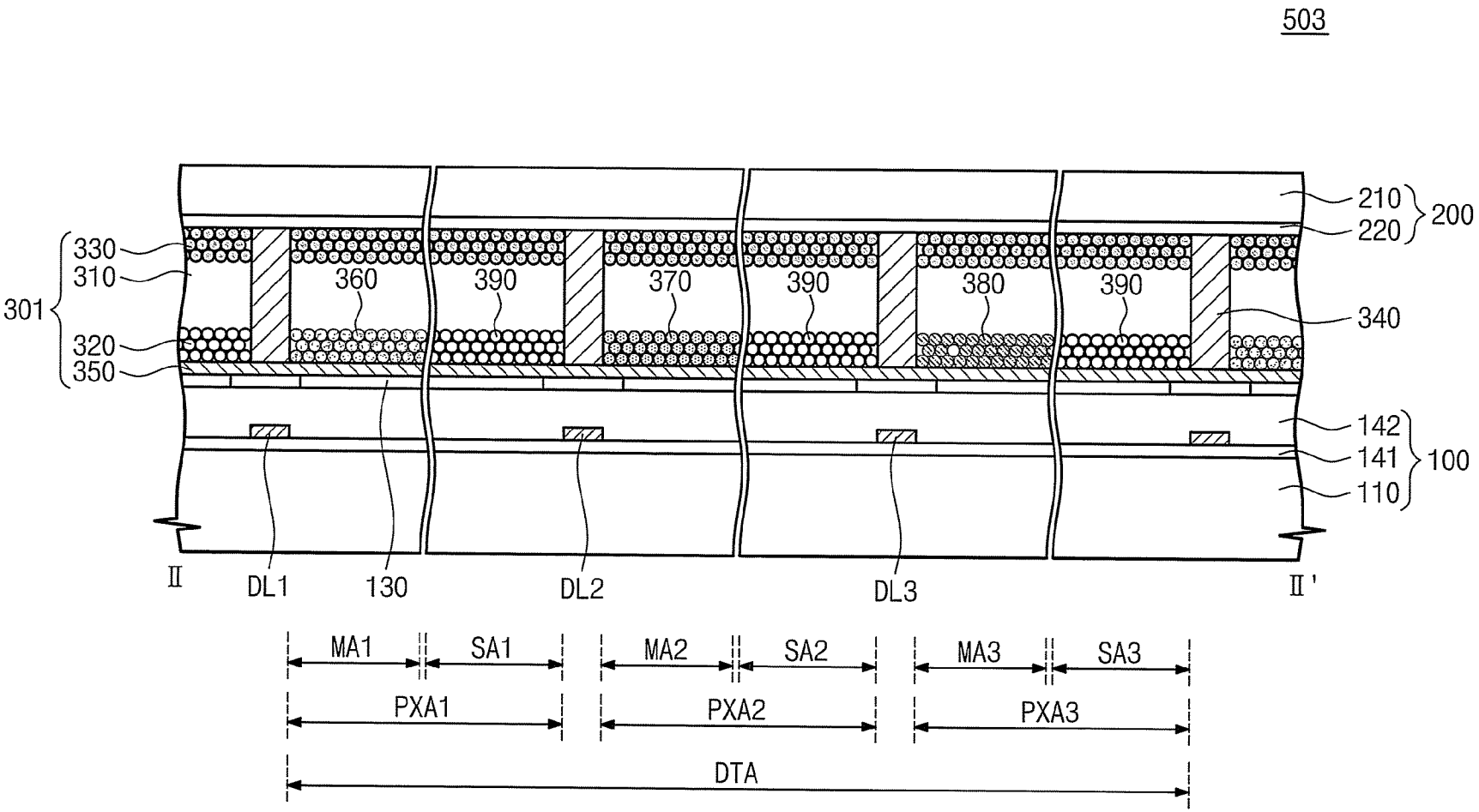
FIG. 7 is a cross-sectional view showing a portion of another exemplary embodiment of the display panel of FIG. 5.

FIG. 7 is a cross-sectional view showing a portion of another exemplary embodiment of the display panel of FIG. 5. In FIG. 7, the same reference numerals denote the same elements in FIGS. 5 and 6, and thus the detailed descriptions of the same elements will be omitted.

Referring to FIG. 7, a display panel 503 includes a first display substrate 100, a second display substrate 200, and an electrophoretic layer 301 interposed between the first and second display substrates 100 and 200.

The first display substrate 100 includes a plurality of dot areas DTA each of which has first, second and third pixel areas PXA1, PXA2 and PXA3. The first pixel area PXA1 includes a first main area MA1 and a first sub area SA1, the second pixel area PXA2 includes a second main area MA2 and a second sub area SA2, and the third pixel area PXA3 includes a third main area MA3 and a third sub area SA3.

The electrophoretic layer 301 includes a fluid layer 310 of insulating liquid, black, red, green, blue and white particles 330, 360, 370, 380 and 390 dispersed in the fluid layer 310, and a barrier wall 340.

In the present exemplary embodiment, the red particles 360 are arranged in the first main area MA1, the green particles 370 are arranged in the second main area MA2, the blue particles 380 are arranged in the third main area MA3, and the white particles 390 are arranged in the first to third sub areas SA1~SA3. The black particles 330 are arranged in the first to third main areas MA1~MA3 and in the first to third sub areas SA1~SA3. The black particles 330 have a different polarity from the red, green, blue and white particles 360, 370, 380 and 390.

More specifically, the red, green, blue and white particles 360, 370, 380 and 390 move to either the first display substrate 100 or the second display substrate 200 in accordance with an electric field formed between the common electrode 220 and the pixel electrodes 130. The gray-scales of the first to fourth pixel areas PXA1~PXA4 depend on the colors and the number of the particles positioned adjacent to the second display substrate 200. The colors and the number of the particles positioned adjacent to the second display substrate 200 are determined according to gray-scale values of the pixel areas PXA1~PXA4. The gray-scales of the first to third main areas MA1~MA3 and the first to third sub areas SA1~SA3 depend on the colors and the number of the particles positioned adjacent to the second display substrate 200. The colors and the number of the particles positioned adjacent to the second display substrate 200 are determined according to the gray-scale values of the corresponding main and sub areas.

In the present exemplary embodiment, a method of determining the gray-scale values of the first to third main areas MA1~MA3 and the first to third sub areas SA1~SA3 is the same as that of the gray-scale values of the display panel 502 shown in FIGS. 5 to 6.

The electrophoretic layer 301 further includes an adhesive 350 that attaches the electrophoretic layer 301 to the first display substrate 100. The adhesive 350 is disposed between the fluid layer 310 and the first display substrate 100 and between the barrier wall 340 and the first display substrate 100 to attach the electrophoretic layer 301 to the first display substrate 100.

According to the above, the gray-scale generator generates the gray-scale value of the white color using the gray-scale values of the red, green and blue colors and the brightness ratio between the red, green and blue colors. Thus, the EPD may prevent the chroma of the pure color from being lowered since the gray-scale of the white color is not fixed to zero when displaying the pure color.

Further, the display panel may include the sub area formed in each of the pixel areas in order to adjust the gray-scale of the white color and differently set the gray-scale values of the sub areas used to adjust the white balance and of the sub areas used to adjust the brightness.

Consequently, the EPD may increase the gray-scale display range and enhance the brightness thereof, thereby improving the display quality.

Although exemplary embodiments of the present invention have been described, it is understood that the present invention should not be limited to these exemplary embodiments but various changes and modifications can be made by one of ordinary skill in the art within the spirit and scope of the present invention as hereinafter claimed.

What is claimed is:

1. An electrophoretic display comprising:

a display panel including first, second and third pixel areas arranged in a first direction, each of the first, second and third pixel areas having a main area and a sub area adjacent to the main area, each sub area displaying a white color, the display panel comprising a plurality of electrophoretic particles that has a color and a polarity and is arranged in the first, second and third pixel areas, the display panel receiving gray-scale voltages of the main and sub areas to display an image; and a gray-scale generator receiving an image signal to generate a gray-scale value corresponding to the main area of each of the first, second and third pixel areas, generating a gray-scale value corresponding to the sub area of each of the first, second and third pixel areas by using the gray-scale value corresponding to the main area of each of the first, second and third pixel areas, and outputting the gray-scale voltages according to generated gray-scale values, wherein the gray-scale generator generates a first gray-scale value corresponding to the white color based on a brightness ratio between the main areas of the first to third pixel areas and the gray-scale values of the main areas, and at least one of the sub areas has the first gray-scale value, wherein the first gray-scale value is obtained by adding a first value obtained by multiplying a first brightness ratio constant by the gray-scale value of the main area of the first pixel area, a second value obtained by multiplying a second brightness ratio constant by the gray-scale value of the main area of the second pixel area, and a third value obtained by multiplying a third brightness ratio by the gray-scale value of the main area of the third pixel area, and wherein the first, second and third brightness ratio constants are obtained from a brightness ratio between the main areas of the first to third pixel areas when the main areas of the first, second and third pixel areas have a same gray-scale value; and wherein the gray-scale generator multiplies a smallest gray-scale value among the gray-scale values of the main areas of the first to third pixel areas by a white ratio constant to calculate a second gray-scale value corresponding to the white color, a remaining sub area not including the at least one sub area has the second gray-scale value, and the white ratio constant is used to adjust a white color ratio with respect to a color generated by mixing colors displayed in the first to third pixel areas and has a value of about 0 to about 1.

2. The electrophoretic display of claim 1, wherein the first brightness ratio constant is in a range of about 0.2 to about 0.4, the second brightness ratio constant is in a range of about 0.5 to about 0.7, and the third brightness ratio constant is in a range of about 0.05 to about 0.2, wherein the gray-scale value of the main area of the first pixel area is a red-color gray-scale value, the gray-scale value of the main area of the second pixel area is a green-color gray-scale value, and the gray-scale value of the main area of the third pixel area is a blue-color gray-scale value.

3. The electrophoretic display of claim 2, wherein a sum of the first, second and third brightness ratio constants is 1.

4. The electrophoretic display of claim 1, wherein the display panel further comprises:

a first display substrate comprising a pixel electrode arranged in the main and sub areas to receive the gray-scale voltage;

a second display substrate facing the first display substrate and comprising a common electrode to which a common voltage is applied; and an electrophoretic layer disposed between the first and second display substrates, the electrophoretic layer comprising the electrophoretic particles.

5. The electrophoretic display of claim 4, wherein the display panel further comprises a color filter comprising a plurality of color pixels arranged on the second display substrate, and the color pixels correspond to the main areas of the first to third pixel areas, respectively, and display colors using a light, wherein the color pixels comprise:

a red color pixel corresponding to the main pixel of the first pixel area;

a green color pixel corresponding to the main pixel of the second pixel area; and a blue color pixel corresponding to the main pixel of the third pixel area, wherein the electrophoretic particles comprise:

a plurality of black particles arranged in the first to third pixel areas; and a plurality of white particles arranged in the first to third pixel areas, the white particles having a different polarity from that of the black particles.

6. The electrophoretic display of claim 4, wherein the electrophoretic particles comprise:

a plurality of red particles corresponding to the main area of the first pixel area;

a plurality of green particles corresponding to the main area of the second pixel area;

a plurality of blue particles corresponding to the main area of the third pixel area; and a plurality of white particles corresponding to the sub areas of the first to third pixel areas.

7. The electrophoretic display of claim 6, wherein the electrophoretic particles further comprise a plurality of black particles arranged in the main and sub areas and having a different polarity from that of the red, green, blue and white particles.

8. The electrophoretic display of claim 1, wherein the first, second and third pixel areas are arranged in the first direction, and the sub areas are adjacent to the main areas, respectively, in a second direction substantially perpendicular to the first direction.

* * * * *